US010767827B2

(12) United States Patent
Zozgornik

(10) Patent No.: US 10,767,827 B2
(45) Date of Patent: Sep. 8, 2020

(54) LED LIGHTING DEVICE

(71) Applicant: Lumileds Holding B.V., Schiphol (NL)

(72) Inventor: Steffen Zozgornik, Leverkusen (DE)

(73) Assignee: Lumileds Holding B.V. (NL)

( * ) Notice: Subject to any disclaimer, the term of this patent is extended or adjusted under 35 U.S.C. 154(b) by 0 days.

(21) Appl. No.: 16/590,195

(22) Filed: Oct. 1, 2019

(65) Prior Publication Data

US 2020/0103086 A1 Apr. 2, 2020

(30) Foreign Application Priority Data

Oct. 2, 2018 (EP) ..... 18198209

(51) Int. Cl.

| | |
|---|---|
| ***F21V 3/00*** | (2015.01) |
| ***F21V 5/00*** | (2018.01) |
| ***F21S 41/24*** | (2018.01) |
| ***F21S 41/143*** | (2018.01) |
| ***F21S 41/151*** | (2018.01) |
| ***F21S 41/20*** | (2018.01) |
| ***F21V 5/04*** | (2006.01) |
| *F21Y 115/10* | (2016.01) |

(52) U.S. Cl.

CPC ..... *F21S 41/24* (2018.01); *F21S 41/143* (2018.01); *F21S 41/151* (2018.01); *F21S 41/285* (2018.01); *F21V 5/043* (2013.01); *F21Y 2115/10* (2016.08)

(58) Field of Classification Search

CPC ..... F21S 41/00–153; F21S 41/20–295; F21V 5/008; F21V 5/04; F21V 5/043; F21V 5/046

USPC ..... 362/249.02, 311.02, 511, 538–545

See application file for complete search history.

(56) References Cited

FOREIGN PATENT DOCUMENTS

| | | | |
|---|---|---|---|
| EP | 2690351 | A2 | 1/2014 |
| JP | 2018055907 | A | 4/2018 |
| WO | 2006096467 | A2 | 9/2006 |
| WO | 2011121488 | A1 | 10/2011 |

OTHER PUBLICATIONS

Extended European Search Report dated Nov. 26, 2018, EP Application No. 18198209.1, 6 pages.

*Primary Examiner* — Jason M Han

(57) ABSTRACT

The invention describes an LED lighting device comprising an imaging optic and an illumination unit, wherein the illumination unit comprises a row of a plurality of LEDs and a pre-collimator collimating the light emitted by the LEDs, and the imaging optic is arranged such that a focal plane of the imaging optic coincides with the LED row of the illumination unit.

The invention further describes a respective automotive headlight, and a method for the assembly of an LED lighting device.

14 Claims, 7 Drawing Sheets

LED LIGHTING DEVICE

CROSS REFERENCE TO RELATED APPLICATIONS

This application claims priority to European Patent Application No. 18198209.1 filed on Oct. 2, 2018 titled "LED LIGHTING DEVICE." European Patent Application No. 18198209.1 is incorporated herein by reference.

FIELD OF THE INVENTION

The invention describes an LED lighting device, a directional lighting unit, and a method for the assembly of a lighting device.

BACKGROUND OF THE INVENTION

For headlights, it is more and more common to use semiconducting light sources, especially light emitting diodes ("LED"s). Especially for adaptive headlights, a row or an array of LEDs is used to obtain an illumination pattern.

The emission of an LED is usually Lambertian. A semiconductor diode often comprises an active area, a sealant or side coating on all sides of the device and a corpus surrounding the actual light emitting medium. Due to the side coating, there is always a gap between the active areas of two adjacent LEDs, even if they touch each other. To gain efficiency and to close the gaps between the individual LEDs, it is common to use a collimation optic using total internal reflection ("TIR"). These collimators have individual "fingers" that are positioned over the individual LEDs, such that a "finger" is arranged over every LED. Usually the exit face of the collimator is imaged to the far-field (infinity) by a lens.

Concerning the gaps between individual LEDs, it is a problem that the collimators with individual entry faces for each LED are difficult to manufacture and difficult to adjust to all LEDs.

Concerning an LED-array, it is a problem that direct imaging systems with an LED array need a very large and complicated projection optic or they are not efficient due to the Lambertian emission characteristics of the LED.

WO2006096467A2 discloses a vehicle headlamp comprising a row of LEDs whose light is collected by a primary optical light guide having the form of a trapezoidal polypiped with an elongated rectangular entrance window facing the LEDs for light input. Such primary optical light guide outputs the collected light via an elongated rectangular exit window to a secondary light guide, e.g. a lens, which directs the light onto a road in front of the vehicle.

Therefore, it is an object of the invention to provide an improved LED lighting device that overcomes the problems described above.

SUMMARY OF THE INVENTION

This object is achieved by the LED lighting device of claim 1, the directional lighting unit of claim 12, and the method of claim 14 of assembly of a lighting device.

It should be noted, that with the term "LED" all possible semiconducting light sources, including semiconductor lasers, are included. However, light emitting diodes and/or organic light emitting diodes ("OLED"s) are most common and most preferred for the invention.

The LED lighting device of the invention is preferably usable for an adaptive directional lighting unit, in particular for the technical field of automotive. The (preferably front lighting) LED lighting device comprises an imaging optic, e.g. a lens, and one or several illumination units. The imaging optic is preferably arranged to image the light into the far-field, e.g. in a headlight.

An illumination unit comprises a row of LEDs ("LED row") with a plurality of LEDs and a pre-collimator collimating the light emitted by the LEDs. An illumination unit might also comprise more than one LED row. Although an LED row may have any desired elongated shape (e.g. curved), the LEDs of an LED row are preferably arranged linearly, so that their midpoints are on a (preferably straight) line. The LEDs in the LED row are preferably arranged such that they have negligible gaps to adjacent LEDs of the LED row. Thus, the LEDs are preferably arranged such that essentially each LED touches the LEDs adjacent in the LED row. It is preferred that all LED rows in the lighting device are arranged on one single plane.

The pre-collimator of an illumination unit may comprise an exit face and an entry face arranged at opposite sides. The entry face is smaller than the exit face and usually covers the area of the LED row, preferably essentially completely. In other words, most light emitted by the LED row (except the light emitted by the largest emission angles) enters the entry face, and most of this light exits at the exit face (on a direct way or due to total internal reflection). It is clear that the entry face must face the LED row and the exit face must face the imaging optic in the usual manner.

The entry face may comprise two long edges and two short edges. Thus, it has an elongated shape at least similar to the form of the LED row, since it covers the elongated LED row. Since a straight LED row is preferred, a rectangular shape of the entry face is preferred.

As a three-dimensional geometric shape, the pre-collimator comprises edges and faces, wherein the faces meeting the short edges of the entry face are called "small side faces", since these parts are relatively small side faces, and the faces meeting the long edges of the entry face are called large side faces. The small and large side faces lie between the exit face and the entry face and are considered as the sides of the pre-collimator. The pre-collimator can have the shape of a polyhedron with planar faces (it preferably has the shape of a frustrum). In an alternative embodiment, it can have curved faces. For example, the entry face and the exit face are planar faces and at least one large face can be curved.

It is essential for the invention that the imaging optic is arranged such that a focal plane of the imaging optic coincides with the LED row of at least one of the illumination units, preferably of all illumination units. Thus, the focal plane is arranged in the plane of the active faces of the LEDs of the respective LED rows (i.e. where the light is emitted). Such coincidence has to be understood in a technical sense, i.e., does not have to be exact, but only has to fulfil its intended technical function. In other words, an "essential" coincidence is sufficient for the invention, where "essential" means that the focal plane may be slightly removed from the LED row or may touch only some fractions of the LEDs if emission surfaces are not flat. However, it is preferred that the focal plane touches the LED rows at the emission surfaces of the LEDs or is at least not more than 2 mm distanced to the LED rows, particularly 1 mm or less. It can be said that the imaging optic is arranged such that it images the surface of the LED row. In other words, the focal plane of the imaging optic is positioned at the emission surfaces of the LEDs, i.e. outside the pre-collimator.

Since the pre-collimator has a certain refractive index, the light emitted from the LEDs of the LED row is refracted by the pre-collimator. Therefore, the focal plane of the imaging optic is moved from its theoretical position by the pre-collimator. One can say that the pre-collimator shifts the position of the focal plane. Thus, all references to the position of the focal plane must be understood under consideration of the refraction of the pre-collimator. In other words, taken precisely, the terminology "the focal plane of the imaging optic" actually refers to the "focal plane of the system consisting of imaging optic and pre-collimator". Thus, the imaging optic should always be arranged under consideration of the refractive properties of the pre-collimator.

The imaging optic can comprise an arrangement of a number of optical elements, preferably selected from the group comprising lenses, prisms and mirrors. It is preferred that the imaging optic comprises only one single lens, since this renders the imaging optic easy to handle and cost effective. In an automotive front directional lighting unit the imaging optic is usually arranged to image the focal plane to the far-field.

To facilitate a better understanding, a coordinate system is defined, where the x-axis is the axis along the length of the LED row, the y-axis is the axis perpendicular to the x-axis pointing to the imaging optic, and the z-axis is the axis perpendicular to the x-axis and y-axis. Thus, the LED row is arranged along the x-axis, a line along the y-axis may start at the LED row, enter the pre-collimator through its entry face, exit the pre-collimator through its exit face, and pass through the imaging optic. The z-axis is perpendicular to the x-axis and y-axis.

Any light ray emitted by the LEDs can be separated into a fraction propagating in a (x,y)-plane, defined by the x-axis and the y-axis of this coordinate system, and a fraction propagating in a (y,z)-plane, defined by the y-axis and the z-axis of this coordinate system. The coordinate system should be positioned so that a virtual line through the midpoints of the LEDs of an LED row are exactly on the x-axis.

The LED lighting device can be formed by using only one illumination unit, however, depending on its use, it preferably comprises two or more illumination units.

A directional lighting unit according to the invention is preferably designed for the technical field of automotive. It comprises an LED lighting device according to the invention. The directional lighting unit is preferably designed as an automotive headlight for a vehicle, e.g. for a high beam. The expression "directional lighting unit" should be interpreted as a lamp or lighting unit wherein light is cast in a main direction, e.g. such as in front of a vehicle. Examples for a directional lighting unit are headlights, spotlights, or searchlights.

The invention also pertains to a method for the assembly of a lighting device with an imaging optic and one or more illumination units. The illumination units each comprise a row of LEDs, preferably aligned along a common axis, with a plurality of LEDs, and a pre-collimator collimating the light emitted by the LEDs.

The method comprises the step of arranging the imaging optic such that, taking the refraction of the pre-collimator into consideration, a focal plane of the imaging optic is positioned such that the focal plane essentially coincides with the LED row of at least one of the illumination units. The term "arranging" means in this context "designing" and/or "positioning".

A method, not claimed by the invention, for producing the pre-collimators for an LED lighting device according to the invention, comprises the following steps:

Extrusion forming or press forming of a strand, wherein long edges of entry faces of the later pre-collimators are arranged parallel to the length of the strand. Thus, by looking on the cross-section area of the strand, one looks at the side of a pre-collimator. The preferred material for the strand is obviously transparent. The material is preferably selected from a group comprising glass, plastic and silicone (polysiloxane).

Separating the pre-collimators from the strand by cutting (the strand). It is preferable to cut along the short edges of the entry face of a later pre-collimator, i.e. parallel to the short edges of the entry face. The cutting is preferably done perpendicular to the length of the strand so that the entry faces of the later pre-collimators are rectangular. It is further preferred that the cut is perpendicular to the entry face so that the side walls of a later pre-collimator are perpendicular to the entry face (and parallel to each other). The parallel small side faces facilitate the production, since there is only one simple cutting action necessary while separating pre-collimators from the strand.

It is preferable to polish the faces of a separated pre-collimator (however, not necessarily all faces). This may have a positive effect on the light output of the pre-collimator.

It is preferable to provide the small side faces of the pre-collimator with light absorbing surfaces.

In accordance with this method, a preferred LED lighting device comprises a pre-collimator that is produced by extrusion forming or press forming, and/or separation from a strand by cutting.

The dependent claims and the following description disclose particularly advantageous embodiments and features of the invention. Features of the embodiments may be combined as appropriate. Features described in the context of one claim category can apply equally to another claim category.

According to a preferred LED lighting device, the imaging optic comprises, besides the first focal plane, furthermore a second focal plane. This could e.g. be achieved with an imaging optic comprising two refractive powers at orientations perpendicular to each other. In a coordinate system as defined above:

Light rays within the (x,y)-plane (i.e. parallel to a plane comprising then length of the LED row) are refracted according to the first focal plane. This first focal plane essentially coincides with the (active faces of the) LED row.

Light rays within the (y,z)-plane (i.e. in a plane perpendicular to the length of the LED row) are refracted according to the second focal plane, wherein the distance of the second focal plane to the imaging optic is smaller than the distance of the first focal plane to the imaging optic. Preferably the second focal plane lies in a plane with an optimal intensity distribution. In particular, the second focal plane essentially coincides with the exit face of a pre-collimator (preferably the exit faces of all pre-collimators). As stated above, it must be noted that the positions of the focal planes are always to be understood taking the refraction of the pre-collimator into consideration.

The optimal intensity distribution depends on the application. In an exemplary application, where the distribution is uniform in an area at the exit face of the pre-collimator, the second focal plane could theoretically be positioned any-where in this area of the pre-collimator, wherein it is preferred that the position of the second focal plane is right at the exit face. If the intensity distribution continuously increases towards the exit face, the preferred position of the second focal plane is also at the exit face. However, it can occur that the intensity distribution increases until a maximum intensity is reached inside the pre-collimator and then decreases again. In this case the best position of the second focal plane is the position of the maximum intensity (i.e. the optimal intensity distribution).

It is preferable that the second focal plane lies in a plane with an optimal intensity distribution, in particular essentially at the exit face of a pre-collimator. For example, an imaging lens (used as imaging optic) images the surface of (or close to) the LED in the dimension of the LED row(s). In the perpendicular dimension it images a different surface giving the desired light distribution.

A focal plane is in the following preferably assumed to be flat (not curved), at least in the area concerning the LED row(s). In a practical case, where the focal plane is usually curved (curvature of field) and the LED row is usually flat there could be found a balance according to the following method. First, a flat (theoretical) focal plane is arranged in a desired (theoretical) position. Then the imaging optic is positioned such that (seen from this imaging optic) the (real) focal plane runs behind the (theoretical) focal plane at the middle of the LED row and in front of the (theoretical) focal plane at the sides of the LED row. It is particularly preferred that the (real) focal plane crosses the (theoretical) focal plane at two points at about a quarter and three quarters of the length of the LED row, or that the integrated areas behind and in front of the (theoretical) focal plane are essentially equal. According to another preferred embodiment, the (real) focal plane touches the (theoretical) focal plane at a point in the middle of the LED row. As said above, in the following the flat (theoretical) focal plane is preferably meant, at least in the case the LED row or the exit face are flat.

Furthermore or alternatively, the focal plane is arranged parallel to the respective LED row(s) (first focal plane) or the respective exit face (second focal plane). In particular, the first focal plane is positioned outside the pre-collimator. Depending on the use, it can be preferred that the first focal plane is positioned at the entry face of the pre-collimator.

According to a preferred LED lighting device the imaging optic comprises an aspherical lens, preferably an astigmatic lens (or a toric lens, respectively). Particularly preferred is a lens with two opposite lens surfaces shaped as cylindrical lenses, wherein the focal lines of the two lens surfaces are arranged perpendicular to each other. Preferably the curvature of one lens surface has a larger radius than the curvature of the opposite lens surface so that the lens comprises two different focal planes. Furthermore, a convex lens is preferred with different optical powers and focal lengths in two orientations perpendicular to each other so that the lens comprises two different focal planes.

It is preferred that for one or more, or, preferably, all of the illumination units, in the above defined coordinate system, the pre-collimator is designed such that it collimates light rays propagating in the (y,z)-plane (i.e. in a plane perpendicular to the length of the LED row) and does not collimate light propagating in the (x,y)-plane (in a plane parallel to the length of the LED row).

The small side faces of the pre-collimator that meet the entry face at its short edges are preferably non-collimating small side faces, where light is essentially not reflected but preferably absorbed. The pre-collimator is preferably designed such that there is essentially no Total Internal Reflection (TIR) at its side faces. The small side faces are preferably designed such that a light beam reaching such a small face is essentially not reflected but absorbed. It can be said that by looking at the LED row through the exit face of the pre-collimator, light propagating in a plane perpendicular to the LED row (in the (y,z)-plane) is collimated, light propagating in a plane parallel to the LED row (in the (x,y)-plane) is not collimated. The result is that the illumination optic has an arrangement of LEDs with negligible gaps in the dimension of the LED row and a collimation in the other dimension.

It is preferred t that for one or more, or, preferably, all of the illumination units, the pre-collimator is shaped such that a virtual straight line between an outer edge of the LED row to an outer edge of the imaging optic extends through the body of the pre-collimator without intersecting the small side faces of the pre-collimator. Thus, the small side faces of the pre-collimator are preferably designed such that they do not shadow any of the LEDs towards the imaging optic. This may be achieved by rendering the side faces such that they are spaced sufficiently far away from the LED row.

According to a preferred LED lighting device, the entry face of a pre-collimator is shaped such that the area of the entry face exceeds the area of the LED row by at least the width of an LED of the LED row on both sides of the length of the LED row.

According to a preferred LED lighting device the small side faces (i.e. the faces meeting the short edges of the entry face of a pre-collimator) are parallel to each other and preferably arranged perpendicular to the plane of the entry face (see above manufacturing method).

According to a preferred LED lighting device the large side faces (i.e. the faces meeting the long edges of the entry face of the pre-collimator) are shaped as collimating faces.

According to a preferred LED lighting device the surface of the exit face of a pre-collimator is preferably structured. A preferred structure is roughening, a (especially holographic) light scattering device or a (preferably lenticular) lens array.

It is preferred that the exit face comprises a roughening. This has the advantage that minimal gaps between the images of LEDs are blurred and, therefore, no sharp intensity-transitions can be registered there.

Alternatively or additionally, the exit face comprises a lenticular lens array, wherein the structure is preferably designed such that light is spread in the (x,z) direction (i.e. in a plane perpendicular to the length of the LED row) of the above defined coordinate system.

According to a preferred LED lighting device the (intensity of) LEDs and/or groups of LEDs (preferably full LED rows), may be controlled individually, preferably by dimming or switching. A preferred LED lighting device provides means to control a number of LEDs differently to another number of LEDs of the LED lighting device. A preferred LED lighting device provides means to connect a control for controlling a number of LEDs differently to another number of LEDs of the LED lighting device.

A preferred LED lighting device comprises two or more illumination units that are positioned with spaces between the LED rows of adjacent illumination units. The pre-collimators of the illumination units are arranged such that light spots of adjacent LED rows in the far field overlap with another, wherein preferably there are essentially no gaps between the images of the LED rows. Furthermore or alternatively, the pre-collimators of the illumination units are arranged such that there are essentially no gaps between the images of the illumination units in the far-field.

A preferred directional lighting unit comprises an illumination device with two or more illumination units being, as seen in their intended operating position, arranged in a vertical stack, such that the LED rows are arranged horizontally, with spaces between adjacent LED rows.

Other objects and features of the present invention will become apparent from the following detailed descriptions considered in conjunction with the accompanying drawings. It is to be understood, however, that the drawings are designed solely for the purposes of illustration and not as a definition of the limits of the invention.

BRIEF DESCRIPTION OF THE DRAWINGS

In the drawings, like numbers refer to like objects throughout. Objects in the diagrams are not necessarily drawn to scale.

DETAILED DESCRIPTION OF THE EMBODIMENTS

Figure 1:
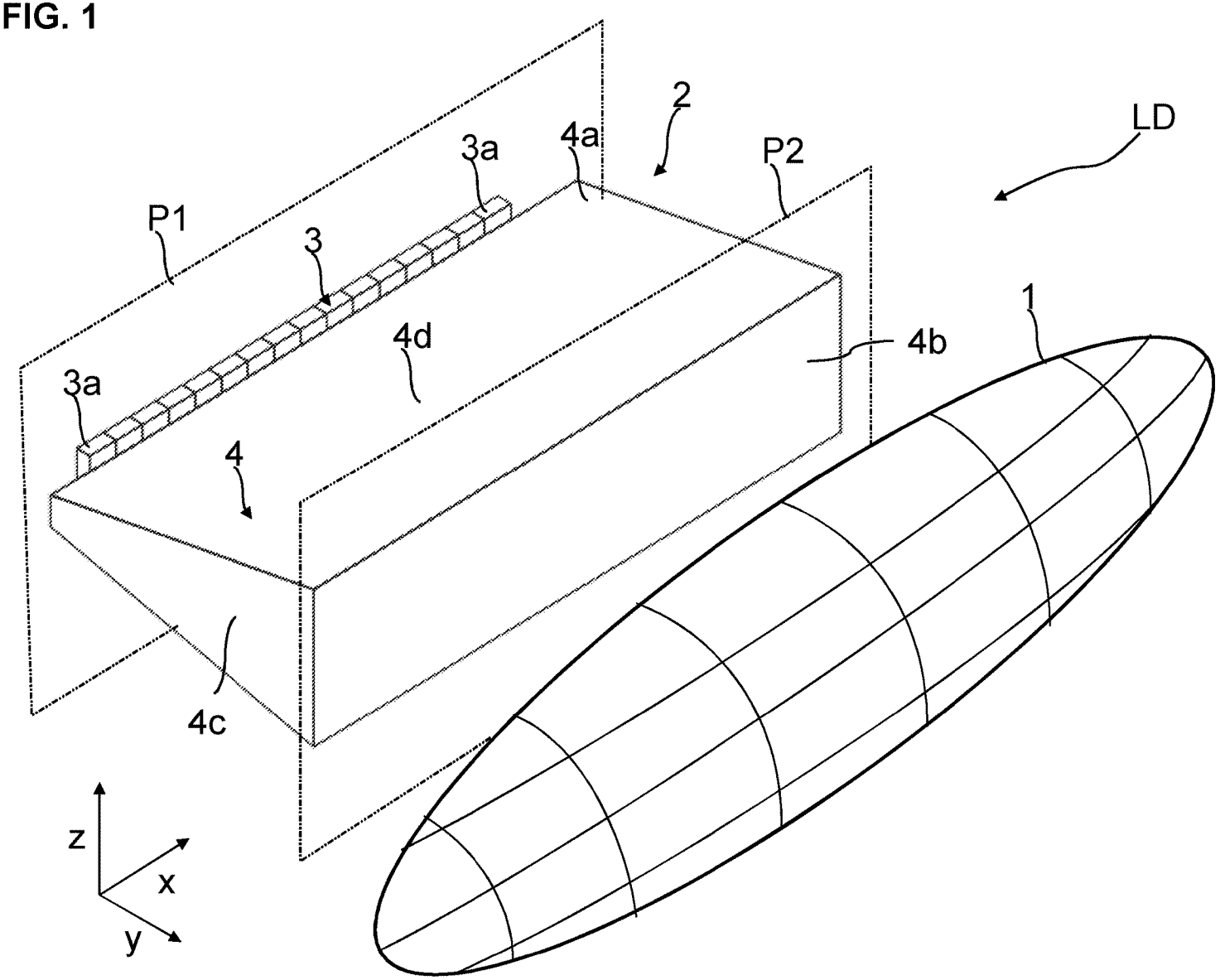
FIG. 1 shows a perspective view of an embodiment of an inventive LED lighting device.

FIG. 1 shows a perspective view of an embodiment of an inventive LED lighting device LD comprising an imaging optic 1 and, in this example a single illumination unit 2.

The illumination unit 2 comprises an LED row 3 with a plurality of LEDs 3*a* (where only the two outer LEDs are equipped with reference signs for better visibility) and a pre-collimator 4 collimating the light emitted by the LED row 3. The pre-collimator 4 comprises an exit face 4*b* and an opposed entry face 4*a*, two small side faces 4*c* and two large side faces 4*d*, wherein the bottom large face 4*d* is not visible. The entry face 4*a* completely covers the area of the LED row 3 and exceeds the area of the LED row (3) by at least the width of an LED (3*a*) of the LED row (3) on both sides of the length of the LED row (3). The entry face 4*a* comprises two short edges and two long edges. The two large side faces 4*d* meet the long edges of the entry face 4*a*, and the two small side faces 4*c* meet the short edges of the entry face 4*a*.

The imaging optic 1 is arranged such that a first focal plane P1, (as always taking the refraction of the pre-collimator 4 into consideration) is positioned essentially at the LED row 3 of the illumination unit 2. Furthermore, a second focal plane P2, is positioned essentially at the exit face 4*b* of the pre collimator 4. The imaging optic 1 in this example is a convex lens with two different focal lines that are perpendicular to each other, resulting in the existence of the two different focal planes P1, P2.

To facilitate a better understanding, a coordinate system is shown as defined above, where the x-axis is the axis along the length of the LED row, the y-axis is the axis perpendicular to the x-axis pointing to the imaging optic, and the z-axis is the axis perpendicular to the x-axis and the y-axis.

Figure 2:
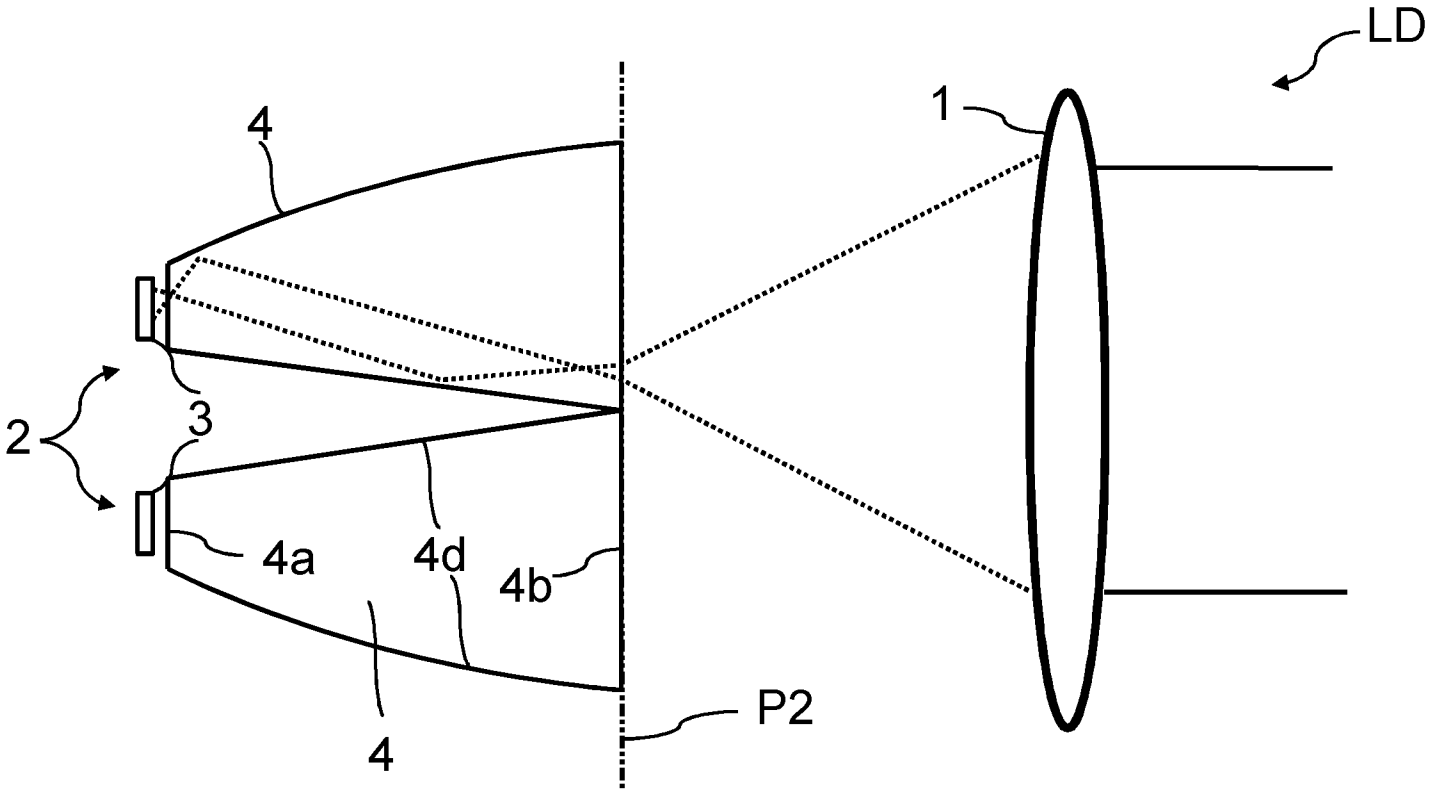
FIG. 2 shows a side view of a further embodiment of an inventive LED lighting device.

FIG. 2 shows a side view of a further embodiment of an inventive LED lighting device LD. In this example, the LED lighting device LD comprises an imaging optic 1 and two illumination units 2.

Figure 3:
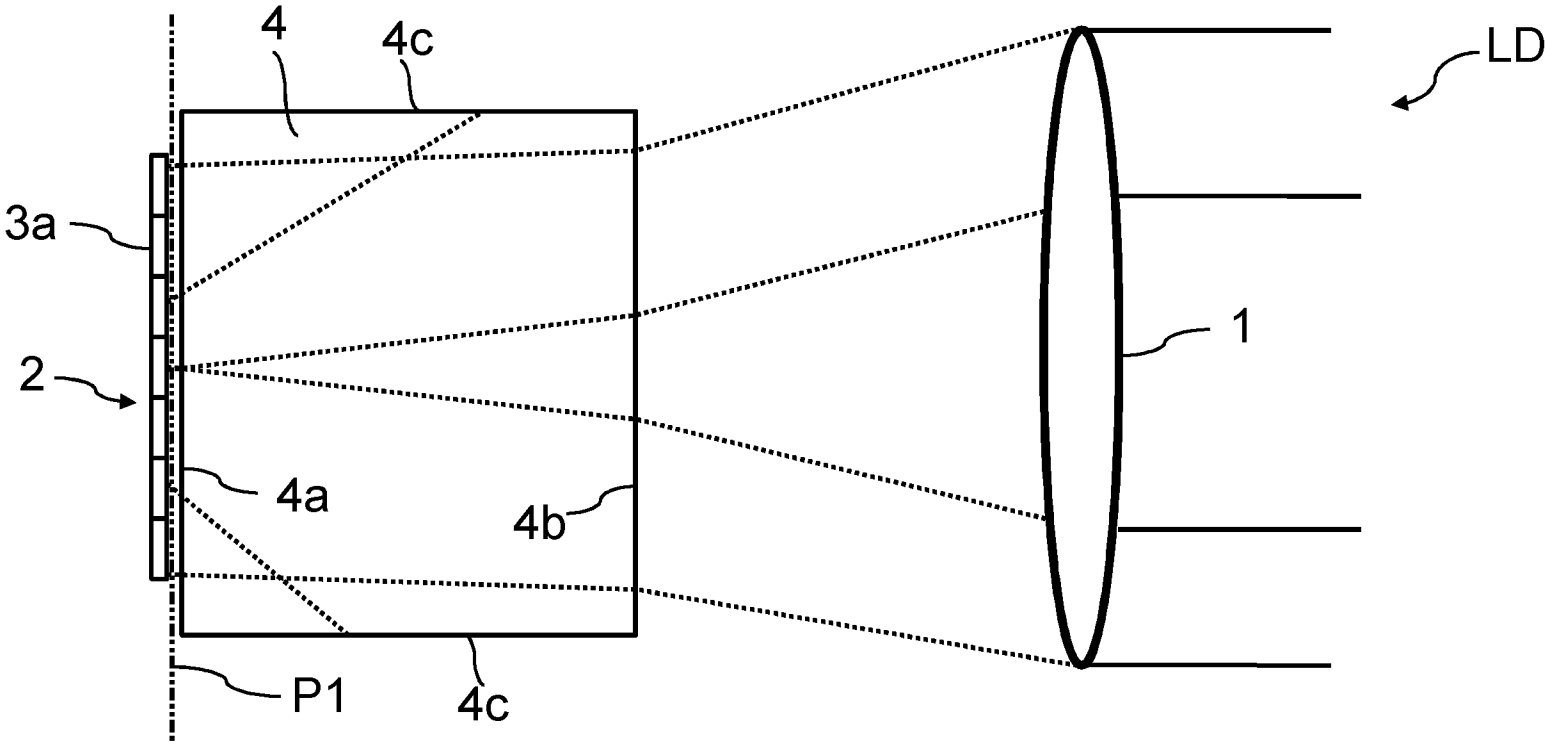
FIG. 3 shows the LED lighting device of FIG. 2 from above.

FIG. 3 shows the LED lighting device LD of FIG. 2 viewed from above. Here only one of the illumination units 2 can be seen, since the other illumination unit 2 lies under this illumination unit 2.

Each illumination unit 2 comprises an LED row 3 with a plurality of LEDs 3*a* (see e.g. FIG. 3) and a pre-collimator 4 collimating the light emitted by the LED row 3. In FIG. 2 two exemplary light beams are shown in the upper pre-collimator 4. These light beams are collimated by the pre-collimator 4. In the lower pre-collimator 4 only the faces are shown and no light beams are drawn (although the light is also collimated there in the same manner as it is collimated in the upper pre-collimator 4). Each pre-collimator 4 comprises an exit face 4*b* and an opposed entry face 4*a*, two small side faces 4*c* (see FIG. 3) and two large side faces 4*d*, wherein the inner large side faces 4*d* are straight and the outer large side faces 4*d* comprise a slight curvature. The entry faces 4*a* extend beyond the area of the LED rows 3, and are at a small distance to the LED rows 3.

In FIG. 3, the influence of the refraction of the pre-collimator 4 on the focal plane can be seen. The light beams exiting the exit face 4*b* are refracted so that their angle of propagation is changed. This effect "shifts" the focal plane of the imaging optic 1 closer to the LED row 3.

In this example, the small side faces 4*c* of the pre-collimators 4 are rendered non-reflective (preferably absorbing). This can be seen in FIG. 3, where light rays reaching the small side faces 4*c* are not reflected but absorbed. Furthermore, in this example, the small side faces 4*c* are parallel to each other, which facilitates the manufacturing of these pre-collimators 4.

In FIG. 2, the second focal plane P2 is shown at the exit face 4*b* of the pre-collimators 4 since, due to its special curvature, the second focal plane P2 of the imaging optic 1 (as always concerning the refraction of the pre-collimators 4) is positioned there for imaging to the far-field the light propagating in the (y,z)-plane. In FIG. 3, the first focal plane P1 is shown at the LED row 3 outside the pre-collimators 4 since, due to its special curvature, the first focal plane P1 of the imaging optic 1 (as always concerning the refraction of the pre-collimators 4) is positioned there for imaging to the far-field light propagating in the (x,y)-plane.

Figure 4:
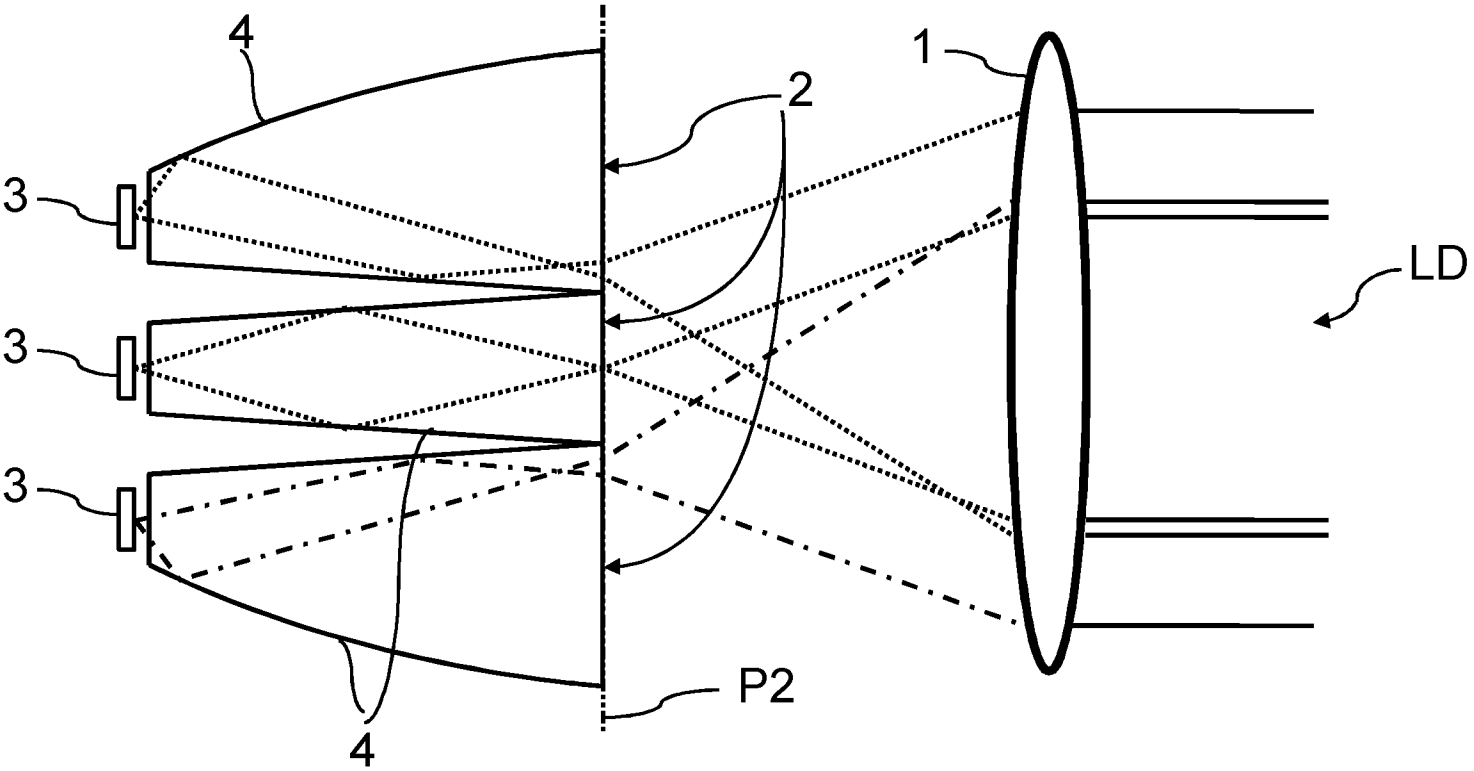
FIG. 4 shows a side view of a further embodiment of an inventive LED lighting device.

FIG. 4 shows a side view of a further embodiment of an inventive LED lighting device LD. The general setup is similar to FIG. 2 differing in that there are three illumination devices 2. In this example, the pre-collimator 4 of the middle illumination device 2 is shaped differently compared to the two other illumination devices 2.

Figure 5:
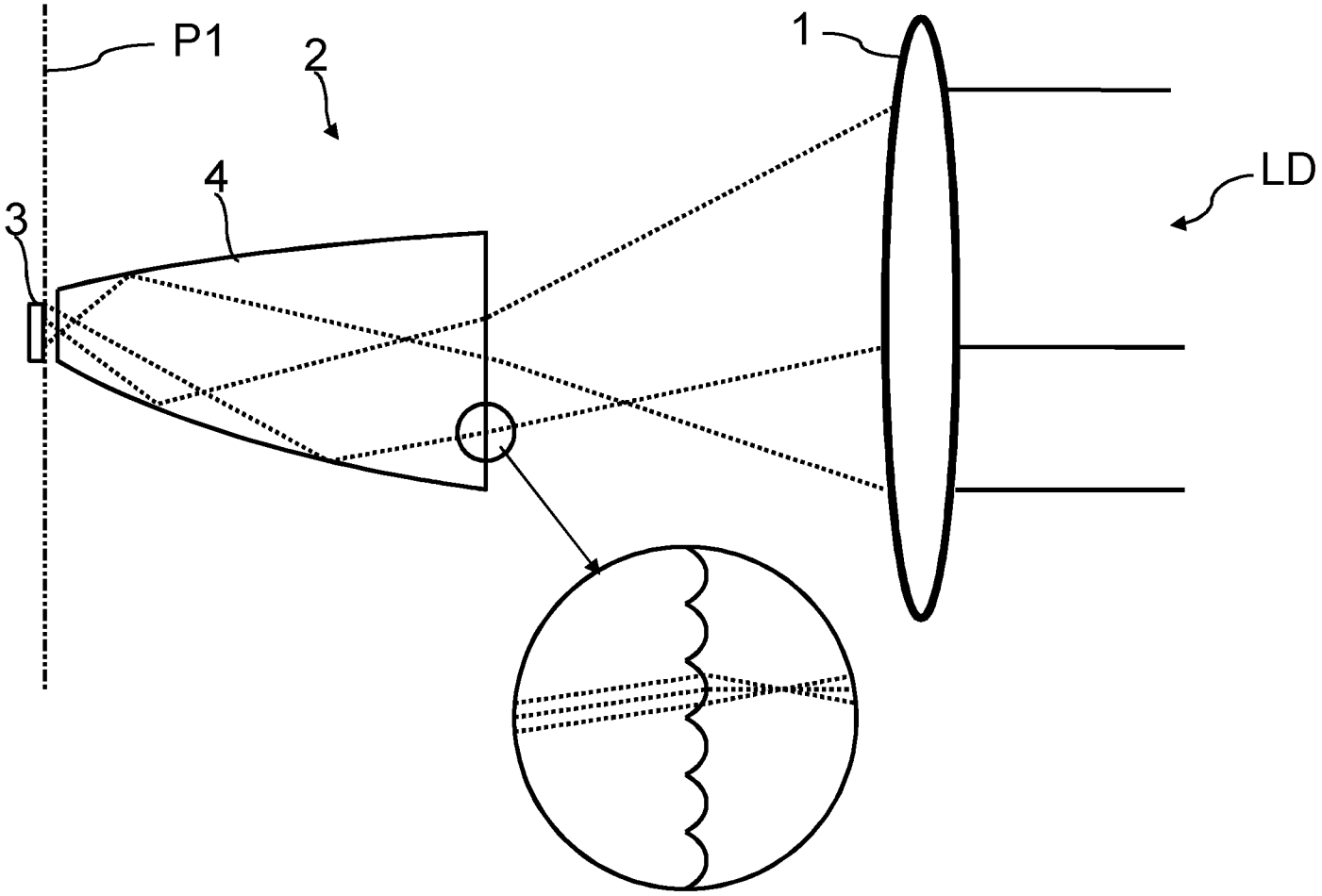
FIG. 5 shows a side view of a further embodiment of an inventive LED lighting device.

FIG. 5 shows a side view of a further embodiment of an inventive LED lighting device LD. The general setup is similar to FIG. 2 or FIG. 4 differing in that there is only one illumination device 2. In this example, the surface of the exit face 4*b* of the pre-collimator 4 is structured with a lenticular lens array that can be seen in the enlarged section below. The structure of the lenticular lens array is designed such that light is spread in the dimension perpendicular to the LED row (in the (y,z)-plane) indicated by the three light beams in the enlarged section.

Figure 6:
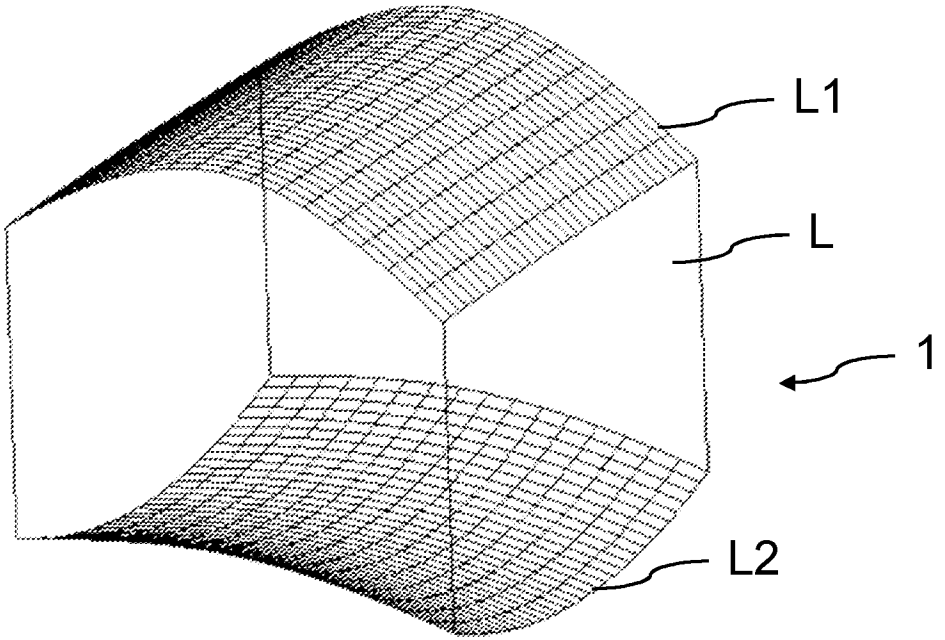
FIG. 6 shows a perspective view of a preferred imaging optic.

FIG. 6 shows a perspective view of a preferred imaging optic. In this example, the imaging optic 1 is a single aspherical lens L shaped as an astigmatic lens L. This lens L comprises two opposite lens surfaces L1, L2 each shaped as a cylindrical lens. The curvatures of the two lens surfaces L1, L2 are arranged perpendicular to each other. Preferably the curvature of one lens surface L1 has a larger or smaller radius than the curvature of the opposite lens surface L2.

Figure 7:
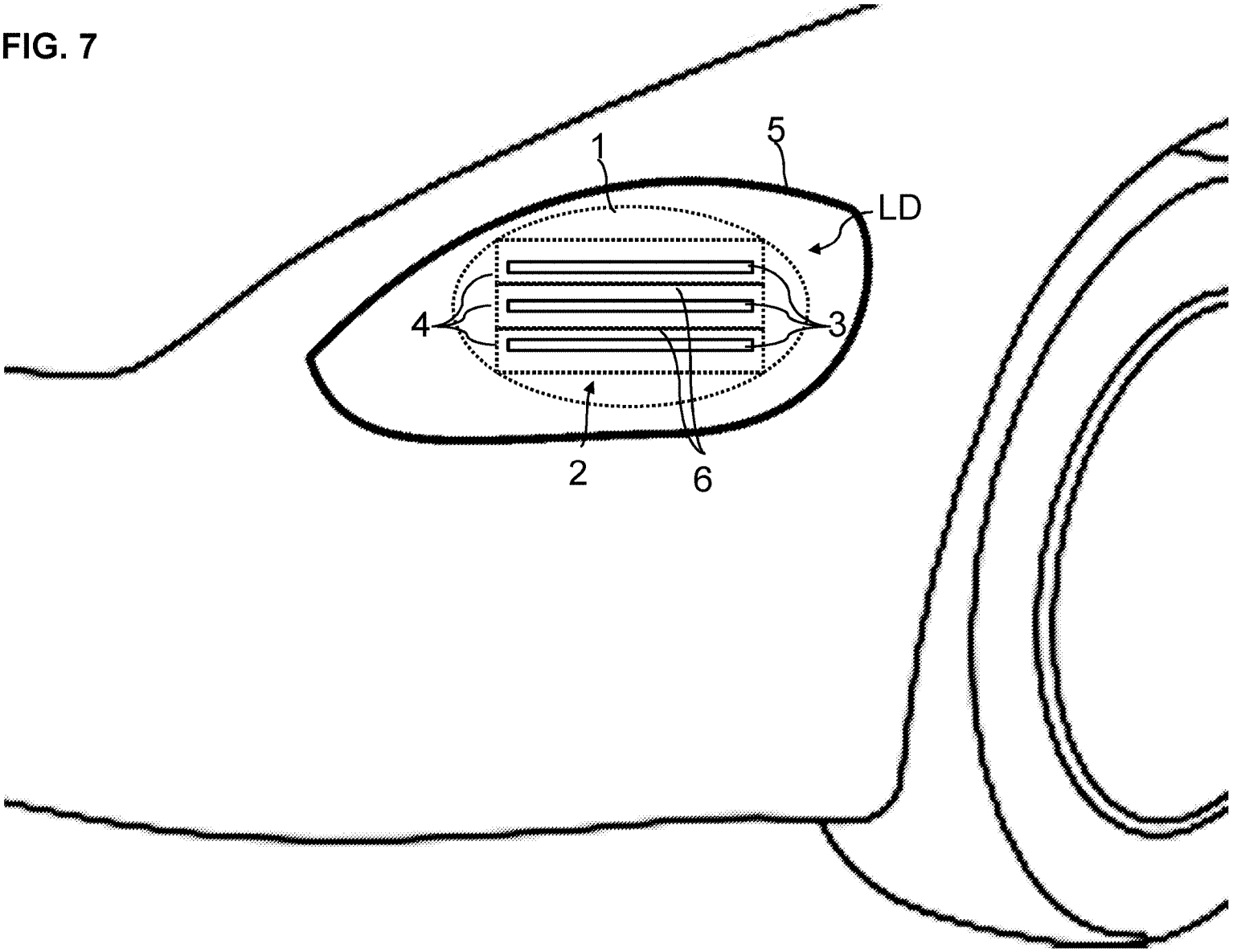
FIG. 7 shows a perspective view of a preferred directional lighting unit.

FIG. 7 shows a perspective view of a preferred directional lighting unit 5 as a headlight 5 of a vehicle. The directional lighting unit 5 comprises an LED lighting device LD with an imaging optic 1, and three illumination units 2, where the pre-collimators 4 of the illumination units 2 are drawn with dashed lines and the LED rows 3 are drawn with solid lines. The illumination units 2 are arranged in a vertical stack, wherein the LED rows 3 are arranged horizontally with spaces 6 between adjacent LED rows 3.

Although the present invention has been disclosed in the form of preferred embodiments and variations thereof, it is to be understood that numerous additional modifications and variations could be made thereto without departing from the scope of the invention.

For the sake of clarity, it is to be understood that the use of "a" or "an" throughout this application does not exclude a plurality, and "comprising" does not exclude other steps or elements. The mention of a "unit" or a "module" does not preclude the use of more than one unit or module.

REFERENCE SIGNS

1 imaging optic
2 illumination unit
3 LED row
3*a* LED
4 pre-collimator
4*a* entry face
4*b* exit face
4*c* small face
4*d* large face
5 directional lighting unit/headlight
6 gap
L lens
L1, L2 lens-surfaces
LD lighting device
P1, P2 focal planea
x, y, z coordinate axes

The invention claimed is:

1. An LED lighting device comprising an imaging optic and an illumination unit, wherein the illumination unit comprises a row of a plurality of LEDs arranged to emit light into a pre-collimator collimating the light emitted by the LEDs, and the imaging optic is arranged such that a first focal plane of the imaging optic lies in a plane with the LED row of the illumination unit.

2. The LED lighting device according to claim 1, wherein the imaging optic, besides the first focal plane, has a second focal plane, wherein, in a coordinate system, where the x-axis is the axis along the length of the LED row, the y-axis is the axis perpendicular to the x-axis pointing to the imaging optic, and the z-axis is the axis perpendicular to the x-axis and the y-axis, light rays propagating within a plane, defined by the x-axis and the y-axis of this coordinate system, are refracted according to the first focal plane, light rays propagating within a plane, defined by the y-axis and the z-axis of this coordinate system, are refracted according to the second focal plane, wherein the second focal plane coincides with an exit face of the pre-collimator.

3. The LED lighting device according to claim 1, wherein the imaging optic comprises an aspherical lens, with two opposite lens-surfaces shaped as cylindrical lenses wherein the focal lines of the two lens-surfaces are arranged perpendicular to each other, or being a convex lens with different optical powers and focal lengths in two orientations perpendicular to each other.

4. The LED lighting device according to claim 1, wherein the pre-collimator is designed such that, in a coordinate system, where the x-axis is the axis along the length of the LED row, the y-axis is the axis perpendicular to the x-axis pointing to the imaging optic, and the z-axis is the axis perpendicular to the x-axis and the y-axis, it collimates light propagating in a—plane, defined by the y-axis and the z-axis of this coordinate system, and does not collimate light propagating in a—plane, defined by the x-axis and the y-axis of this coordinate system, wherein an entry face of the pre-collimator comprises two short edges and two long edges, and wherein two small side faces of the pre-collimator meeting the short edges of the entry face are preferably non-reflecting faces.

5. The LED lighting device according to claim 4, wherein the pre-collimator is shaped such that a virtual straight line between an outer edge of the LED row to an outer edge of the imaging optic extends through the body of the pre-collimator without intersecting the two small side faces of the pre-collimator.

6. The LED lighting device according to claim 1, wherein an entry face of the pre-collimator covers the LED row with the entry face exceeding the LED row by at least the width of an LED of the LED row on both sides of the length of the LED row.

7. The LED lighting device according to claim 4, wherein the small side faces are parallel to each other and perpendicular to the entry face.

8. The LED lighting device according to claim 4, wherein large side faces of the pre-collimator meeting the long edges of the entry face are designed for acting as collimating faces.

9. The LED lighting device according to claim 1, wherein a surface of an exit face of the pre-collimator is structured with a roughening or a lenticular lens array, wherein the structure is designed such that light leaving the pre-collimator through the exit face is spread in a plane, defined by a y-axis and a z-axis of a coordinate system, where an x-axis is the axis along the length of the LED row, the y-axis is the axis perpendicular to the x-axis pointing to the imaging optic, and the z-axis is the axis perpendicular to the x-axis and the y-axis.

10. The LED lighting device according to claim 1, wherein the LEDs can be controlled individually.

11. The LED lighting device according to claim 1, comprising two or more illumination units positioned adjacent to each other with spaces between the LED rows of adjacent illumination units, wherein the pre-collimators of the illumination units are arranged and/or designed such that light beams of adjacent LED rows in the far field overlap with another with no gaps in-between.

12. An automotive headlight for a vehicle, comprising an LED lighting device according to claim 1.

13. The automotive headlight according to claim 12, comprising a lighting device with two or more illumination units arranged, as seen when installed in the vehicle, in a vertical stack with spaces between adjacent LED rows.

14. A method for the assembly of a lighting device with an imaging optic and an illumination unit, wherein the illumination unit comprises a row of a plurality of LEDs arranged to emit light into a pre-collimator collimating the light emitted by the LEDs, comprising the step:

arranging the imaging optic such that a focal plane of the imaging optic is positioned such that the focal plane lies in a plane with the LED row of the illumination unit.

* * * * *